United States Patent [19]

Koller

[11] 4,241,516

[45] Dec. 30, 1980

[54] APPARATUS AND PROCESS FOR TREATING PULVERIZED GRANULAR MATERIAL WITH A FLUID STREAM

[76] Inventor: Hans Koller, Brunnmattstr. 12, CH 6048 Horw, Switzerland

[21] Appl. No.: 29,254

[22] Filed: Apr. 11, 1979

[51] Int. Cl.[3] ..... F26B 17/00; F27B 15/00

[52] U.S. Cl. ..... 34/57 E; 34/10; 432/15; 432/58

[58] Field of Search ..... 34/10, 57 R, 57 D, 57 E; 432/15, 58

[56] References Cited

U.S. PATENT DOCUMENTS 4,051,602 10/1977 Suprunov et al. ..... 34/57 E

*Primary Examiner*—John J. Camby

*Attorney, Agent, or Firm*—Edward L. Brown, Jr.

[57] ABSTRACT

Apparatus and method for the treatment of dusty, pulverized, granular goods. The treatment occurs in a vortex chamber with a tangential entrance opening for the gas and in special cases with a separate entrance opening for the goods, and an exit opening for the gas. To control the retention time of the goods in the vortex chamber, a provision is made that the vortex chamber casing comprises an annulus, concentric to the axis of the chamber at its periphery and located opposite to the discharge opening, for the feed of a further treatment gas and for the discharge of the goods.

9 Claims, 2 Drawing Figures

APPARATUS AND PROCESS FOR TREATING PULVERIZED GRANULAR MATERIAL WITH A FLUID STREAM

BACKGROUND OF THE INVENTION

It is known in the prior art to treat pulverized granular dusty particles in fluid beds with a gaseous fluid. The fluid is blown through a perforated distributor bottom in a vertical direction upwardly across the fluid bed. The particles are converted into a highly fluid mass and maintained in suspension while they are exposed to intensive contact with the treatment gas. These fluid bed processes of the prior art have essential disadvantages. If big and small particles are present, it is difficult to maintain a gas velocity which is suitable to keep all particles in suspension. Small particles can be entrained by the fluidizing gas whereas large particles are not even elevated. The second disadvantage is the comparatively low upper limit of the gas velocity. This requires large equipment, in order to keep the allowable maximum gas velocity below its upper limit at a given feed rate of the goods.

To overcome these disadvantages, flash dryers have been proposed as described in United Kingdom Pat. No. 981,750 and Swiss Pat. No. 520,380. These devices, however, are restricted to high gas velocities, because particles are held in suspension by the rotating gas flow only. This produces high pressure losses and, therefore, high production costs. The high rotational speed of the gas flow can have another disadvantage, an undesired attrition of the particles. A further drawback is involved by the fact that deposits are likely to be formed despite the high rotational speed of the gas. This occurs more readily if the particles to be treated are sticky. These deposits impede the flow and additionally contribute to further deposits.

Another drawback is the fact that various particles of the goods have an undefined path of flight, causing various retention times and, therefore, various treatment periods. In order to obtain a homogeneous treatment period, several apparatuses must be arranged in series which is expensive and space consuming.

Furthermore, the cleaning effort and the pressure difference are much greater when these multi-stage units are utilized. Another drawback of this system is the necessity of installing separators, if counter-directional flow is desired, which represents a source of pressure differentials and requires spacious devices and installations.

It is therefore the object of the present invention to overcome these disadvantages by the arrangement of the fluid bed casing opposite to the discharge nozzle, combined within an annulus, which is concentric and peripherous, for the entry of a second treatment gas and the discharge of the goods. The invented process provides a conversion of the rising gases into a circular fluid bed in an upwardly rising flow of treatment gas. The fluid bed is simultaneously accelerated by the treatment gas flow into the rotating movement, the treatment gas flow being introduced from a tangential direction. The treatment gas is discharged above the fluid bed, whereas the goods are removed from the bed in an opposite direction to the upward treatment gas flow. The goods are kept in suspension by the treatment gas flow rising through the annulus. The flow rate required for this purpose is only a fraction of the total treatment gas flow rate. The greater portion of the treatment gas is introduced in tangential flow. This flow moves the solid-gas-suspension being formed above the annulus into rotation, thus producing a rotary fluidized bed.

With an appropriate selection of the velocities of both treatment gas currents, the rotating fluid bed can be stabilized and may contain a very high concentration of solid particles caused by centrifugal forces. As a consequence of this centrifugal force, which is a multiple of gravity force, the velocity of the treatment gas in the direction from outside to inside can be a multiple of the velocities inherent to conventional fluid beds.

This higher velocity generates better heat and mass transfer rates, both contributing together with the higher velocities to considerably smaller equipment sizes.

In order to forward such particles that have been carried over and deposited toward the center and are therefore removed from the centrifugal field of the flowing gas, the bottom forming the annulus is preferably designed as a rotating plate, so that deposited particles are hurled outside by a centrifugal force which is mechanically generated.

If the plate rotates with higher speed than the fluid bed, an eddy is formed because there are no breaking frictional forces present. An adjustable flap or a pulsation of the treatment gas passing through the annulus allows a discharge of treated goods from the fluid bed downwards, while new goods can be constantly fed into the fluid bed from outside.

A further step of the invention allows the immediate further treatment of the goods after its first treatment in a second, similiar or conventional fluid bed, effecting a genuine counter-current process. Conventional counter-current fluid bed processes have proved successful in exceptional cases only, due to the high susceptibility of clogging in the distributor bottoms. In the invented process, where fluid beds are built-up above relatively wide annuluses, the danger of clogging is overcome.

The rotary current has physical properties like a cyclone, therefore, the leaving off-gas is nearly freed from the solid particles. With coarse and medium fine grain sizes, an additional separation stage for deducting purposes is no longer required. The schematic drawing attached presents an example of the invented apparatus suitable for the explanation of the process:

Figure 1:
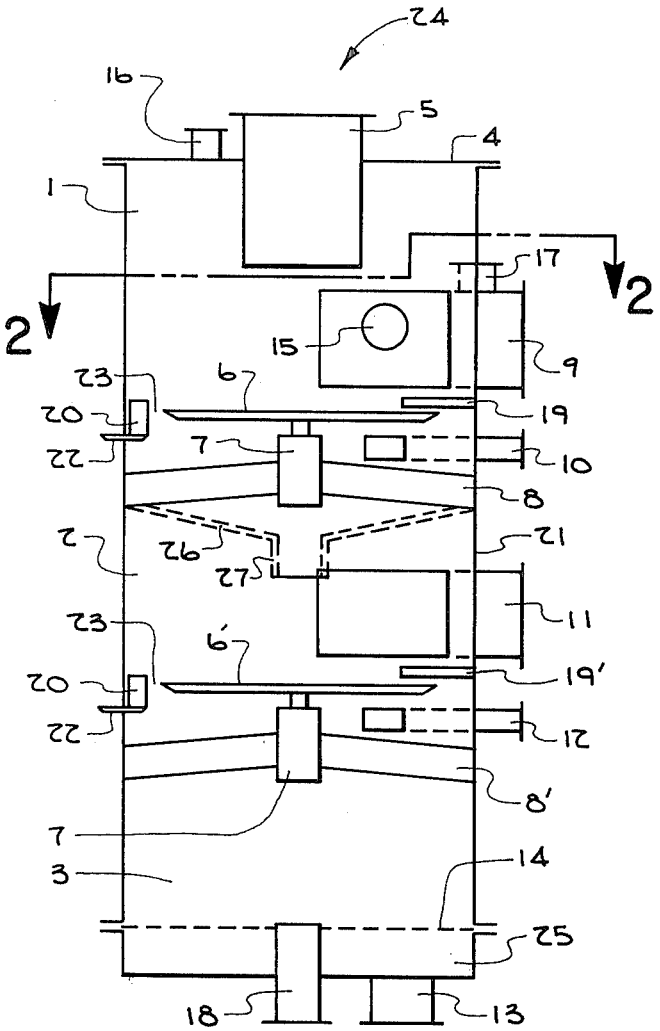
FIG. 1 shows an axial section of a multiple stage apparatus.
Figure 2:
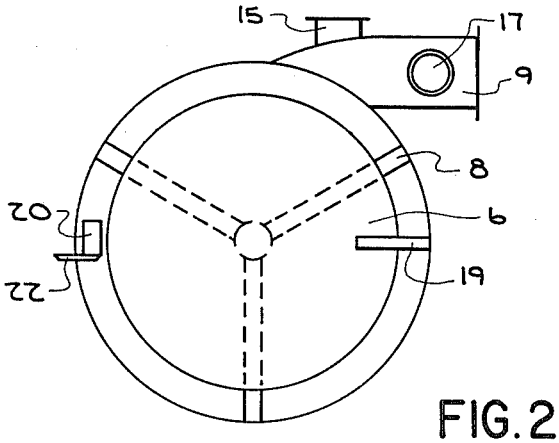
FIG. 2 shows a section along the line A—A.

The multiple device shown in the drawing contains three cylindrical treatment chambers 1, 2 and 3, adjacent to each other, which are laterally confined by a cylindrical shell 21. Lid 4 with an off-gas nozzle covers the superior treatment chamber. Lid 4 is flange-connected to the shell 21, to have easy dismantling for cleaning purposes.

The first treatment chamber 1 is divided from the second treatment chamber 2 by a plate or disc 6. This plate is pivoted around the cylinder axis and driven by a motor 7. Motor 7 supports on its shaft the plate 6, and is mounted on the shell by spiders 8. Instead of a motor 7, the plate 6 could also be driven by other means like a fan wheel by the treatment gas flow rising upwards or fed tangentially. A portion of the treatment gas is applied through nozzle 9. The goods to be treated can also be applied through this nozzle. However, several nozzles 15, 16 and/or 17 can be provided to feed the goods. Shell 21 holds a scraper 19 to wipe off particles depositing on plate 6. The shell 21 carries further, an adjustable shaft 22 which bears a flap 20. According to the pivoting angle of the shaft, flap 20 reaches more or less through the first annulus 23 into treatment chamber 1 and diverts the particles impacting against it into the second treatment chamber 2.

Annulus 23 is confined both by the peripheral rim of plate 6 and by the shell 21. Below plate 6, a nozzle 10 emerges into the second treatment chamber 2 for the addition of further treatment gas for the first treatment chamber 1. The treatment gas entering through nozzle 10 flows upward through annulus 23 and generates above plate 6 together with the particles being treated a rotating fluid bed, which is accelerated by the treatment gas entering through nozzle 9. From the rotating fluid bed, the gas is exhausted through nozzle 5. Consequently, the second treatment chamber 2 represents a chamber of greater pressure than treatment chamber 1, out of which such an amount of treatment gas has to pass through annulus 23 so as to establish a rotating fluid bed above the goods to be treated.

The second treatment chamber 2 is bordered on top by plate 6 and on the bottm by a second co-axial plate 6'. The second plate 6' is pivoted like the first and driven by a motor 7' or other means, the motor being fastened to the cylinder shell 21 by spiders 8'.

As before, a flap 20' is assigned to the second treatment chamber 2, the shape of it depending on the angle of the shaft 22' that carries the flap, and which also serves to discharge the goods to be treated. Both the peripheral rim of plate 6' and the cylinder shell form an annulus 23' as before. For the feed of treatment gas, a nozzle 11 is tangentially attached to treatment chamber 2.

Below plate 6', nozzle 12 is provided for the supply of further treatment gas. This gas fed through nozzle 12 rises upwards through annulus 23' and maintains together with the goods a circular fluid bed, which is brought into rotation by the treatment gas entering through nozzle 11. The off-gas leaving the fluid bed passes upward through annulus 23 into the first treatment chamber 1 and contributes there, together with treatment gas entering via nozzle 10, to the formation of the fluid bed.

As in the case of the first treatment chamber 1, also the second treatment chamber 2 possesses a scraper 19' for the same purpose. The goods to be treated are charged to the second treatment chamber 2 via annulus 23 from the first treatment chamber 1, the pivoting position of the shaft 22 controls the dosage of the goods. Thus, the goods pass from treatment chamber 1 into treatment chamber 2 in the opposite direction as the treatment gas flow. The third treatment chamber 3 represents a pressurized chamber adjacent the second treatment chamber 2. A part of the treatment gas flows from treatment chamber 3 through annulus 23' into the second treatment chamber 2.

The third treatment chamber 3 serves as a final reaction stage and is bordered at its bottom by the perforated plate 14 which acts as a distributor bottom for a conventional fluid bed.

Treatment gas is introduced through nozzle 13 into the pressurized chamber 25, passing from there to the third treatment chamber 3 and forming a fluid bed together with the goods falling from treatment chamber 2 into treatment chamber 3. In the center of the perforated plate 14, a discharge nozzle 18 is provided for the removal of the treated goods, preferably accomplished by a rotary valve, not shown in the drawings.

The width of annulus 23' has to be selected such that further treatment gas can be applied through nozzle 12 in addition to the treatment gas already fed through nozzle 13, in order to achieve a fluid bed.

Also, the width of annulus 23 has to be determined in such a way that treatment gas is allowed to flow through nozzle 10 at such a rate that an axial gas velocity is obtained in annulus 23 which is capable of maintaining a fluid bed. In this manner, the fluid beds in both treatment chambers 1 and 2 can be controlled by adjustment of the air flow rates through nozzles 10 and 12.

In the described apparatus, the method is as follows: the goods are fed into the treatment chamber via nozzles 15, 16 and 17, or any one of these nozzles. Simultaneously, a portion of the treatment gas is applied to nozzle 9, whereas at the same time, the balance of the treatment gas is blown upwardly into the first treatment chamber 1 to form a fluid bed together with the goods. The velocity of the treatment gas passing upward through annulus 23 is controlled by the dosage of the treatment gas coming through nozzle 10. The fluid bed arising above the annulus 23 is brought into rotation by the treatment gas entering through nozzle 9. The treatment gas in the treatment chamber 1 has a tendency to draw the goods inside towards axis 24, whereas the centrifugal forces hurl the particles to the outside. The radial and tangential velocities can, therefore, be adjusted in such a way that a stable rotating fluid bed of the goods to be treated is accomplished. The goods are diverted from treatment chamber 1 towards treatment chamber 2 by means of the diverting flap 20. Instead of the flap, the treatment gas passing from beneath to the first treatment chamber could also be blown through the annulus 23 in a pulsating way so that the goods pass from treatment chamber 1 into treatment chamber 2 in a semi-continuous state, along with the pulsation of the gas.

In treatment chamber 2 the same process is repeated as in treatment chamber 1, with the goods forming the rotating fluid bed above the annulus 23'. From there, the goods are discharged by diverting flap 20' into the treatment chamber 3. In chamber 3, the goods are converted into a conventional fluid bed for any kind of residual reactions, with the treatment gas being introduced through nozzle 13. From the treatment chamber 3, the goods are discharged via nozzle 18.

The goods entering through nozzles 15, 16 and 17 move within the cylindrical shell on their way toward the discharge nozzle 18 against the direction of the treatment gas applied through nozzles 10, 11, 12 and 13, thus producing a genuine counter-current process. The described multistage process also allows the capibility of adjusting the treatment gas given into each of the treatment chambers 1, 2 and 3 from the outside in accordance with the condition of the goods in the relevant chambers.

For example, at a drying process, the treatment chamber 3 can be supplied with dried air, whereas the first two treatment chambers 1 and 2 can be charged with heated ambient air only.

If the equipment described is utilized for agglomerate granulation, a classifier-effect or sifting effect can be achieved by controlling the treatment gas velocity in the annuluses 23 and 23' with the result that only granulates of or above a certain particle size can fall into the following treatment chamber.

As an example not shown and described here, treatment chamber 2 and 3 can be omitted. In this case, a bottom wall 26 is installed (dotted lines in FIG. 1) below nozzle 10, carrying a discharge nozzle 27. Such devices are preferred where a one-stage treatment of the goods is sufficient.

The invention presents the advantage that considerably smaller apparatuses can be employed than with conventional processes, with consequently lower investment costs and reduced heat losses. A further result is that at least the same specific dryer performances are feasible and often even lower residual moistures can be obtained than with flash-dryers, whereas the pressure losses are essentially lower.

A further advantage is the easy access of the apparatus for cleaning purposes. Another advantage is the possibility to feed the solids counter-currently to the treatment gas, thus slashing the operating costs to a great effect as compared to conventional equipment of its kind.

Since the treatment gas is conventionally fed and can be varied to a great extent, a further positive effect lies in a very flexible control of the process.

Having described the invention with sufficient clarity to enable those familiar with the art to construct and use it, I claim:

1. The apparatus for the treatment of dusty, pulverized, granular goods with a gas consisting of a vortex chamber 1 with a tangential entrance opening for the gas and goods and a discharge opening 5 for the gas, said apparatus comprising a vortex chamber casing (4, 6, 21) with an annulus means 23 concentric to the axis of the chamber casing 21 at its periphery and opposite to the discharge opening 5, a rotary plate forming a portion of the vortex chamber and defining the inner diameter of the annulus means rotating about the vortex chamber axis, the annulus means being provided for the entrance of a further treatment gas and for the discharge of the goods.

2. The apparatus defined in claim 1, wherein the annulus means 23 connects the vortex chamber 1 with an over-pressure chamber for futher treatment gas which can be connected via nozzle 10 to a pressure source for the supply of a portion of further treatment gas and presents a discharge opening (18, 27) for the goods.

3. The apparatus defined in claim 1, including a driving element 7 for the plate 6.

4. The apparatus defined in claim 2, including a diverting flap 20 positioned in the annulus means which can be pivoted into the vortex chamber 1 and which points from the vortex chamber 1 into the over-pressure chamber.

5. The apparatus defined in claim 1, including a scraper 19 positioned on the chamber casing 21 for scraping the plate 6.

6. The apparatus defined in claim 2, wherein the over-pressure chamber is designed as a second vortex chamber 2 adjacent to the first vortex chamber 1.

7. The apparatus defined in claim 6, wherein the vortex chamber casing of the second vortex chamber has an annulus 23' located at a certain distance from annulus 23 of the first vortex chamber.

8. The apparatus defined in claim 7, wherein the part of the vortex chamber casing of the second vortex chamber 2 extending from the second annulus 23' towards the axis of the vortex chamber comprises a rotating plate 6'.

9. The apparatus defined in claim 8, wherein the second annulus 23' connects the second vortex chamber 2 with a second over-pressure chamber 3 for the entry of further treatment gas, the over-pressure chamber 3 provided with a nozzle 12 for a pressure source for the feed of at least a portion of further treatment gas and with a discharge opening 18 for the treated goods.

* * * * *